US010595623B2

(12) United States Patent
Vargas et al.

(10) Patent No.: US 10,595,623 B2
(45) Date of Patent: Mar. 24, 2020

(54) COSMETIC BRUSH

(71) Applicants: John Vargas, West New York, NJ (US); Anabel Vargas, West New York, NJ (US)

(72) Inventors: John Vargas, West New York, NJ (US); Anabel Vargas, West New York, NJ (US)

( * ) Notice: Subject to any disclaimer, the term of this patent is extended or adjusted under 35 U.S.C. 154(b) by 309 days.

(21) Appl. No.: 15/331,644

(22) Filed: Oct. 21, 2016

(65) Prior Publication Data

US 2017/0112270 A1 Apr. 27, 2017

Related U.S. Application Data

(60) Provisional application No. 62/244,530, filed on Oct. 21, 2015.

(51) Int. Cl.

| | |
|---|---|
| ***A46B 9/02*** | (2006.01) |
| ***A46B 1/00*** | (2006.01) |
| ***A46B 5/00*** | (2006.01) |
| ***B25G 1/10*** | (2006.01) |
| ***A46D 1/00*** | (2006.01) |
| ***A46B 5/02*** | (2006.01) |

(52) U.S. Cl.

CPC ..... *A46B 9/021* (2013.01); *A46B 5/0095* (2013.01); *A46B 5/02* (2013.01); *A46D 1/0207* (2013.01); *B25G 1/102* (2013.01); *A46B 2200/1046* (2013.01)

(58) Field of Classification Search

CPC ..... A46B 9/021; A46B 5/0095; A46B 5/02; A46D 1/0207; B25G 1/102

See application file for complete search history.

(56) References Cited

U.S. PATENT DOCUMENTS

| | | | | |
|---|---|---|---|---|
| 9,039,314 | B2 * | 5/2015 | Thorpe | A45D 27/04 401/29 |
| D843,735 | S * | 3/2019 | Jinadu | D4/138 |
| 2005/0011030 | A1 * | 1/2005 | Gonzalez | A46B 5/02 15/160 |

* cited by examiner

*Primary Examiner* — Shay Karls

(57) ABSTRACT

An ergonomic cosmetics brush with separable handle body and brush head is provided. The handle body has a curved, tear-drop shape that is comfortable to hold. The handle body curves from a wider firs tend to a narrower opposite end. A flat surface is also provided for attachment of the brush head. The flat surface includes a hold that receives a corresponding part of the brush head. The brush head is securely attached to the handle body by magnets. The brush head is interchangeable, and different brush heads may be provided with different shapes which are ideal for specific cosmetic applications and artistic effects. Examples of shapes include circles, rectangles, and diamonds, while an applicator surface of the brush can be flat, inclined, or domed.

10 Claims, 16 Drawing Sheets

COSMETIC BRUSH

The current application claims a priority to the U.S. Provisional Patent application Ser. No. 62/244,530 filed on Oct. 21, 2015.

FIELD OF THE INVENTION

The present invention relates generally to a cosmetics brush with a rounded handle with a generally tear-drop shape and a removable brush head. The brush head may be made of different materials, such as wood or manmade materials, and be given different shapes. The present invention can be utilized in the application of beauty and skin care products, including those used for arts and special effects.

BACKGROUND OF THE INVENTION

Specialty cosmetics brushes are provided for a variety of specific cosmetics and application techniques. While having the right tool for the job is always a boon, some persons may find it costly in terms of storage and money to keep a large number of brushes. The present invention seeks to address this by providing a removable brush head. The removable brush head allows for a user to easily swap out the right brush head for the right job. Further benefits of the removable brush head included easier cleaning (when separated from the handle), which is important for the maintenance and continued functionality of any good cosmetics brush. The present invention is not restricted to removable brush heads: in some embodiments may be permanently affixed to the handle, still providing the benefits of a unique shaped handle and brush head. A magnetic insert within the handle helps to hold the brush head in place, while also allowing for the present invention to be secured to a metallic base. A further benefit of the magnet is the neutralization of static that often occurs in brushes.

The present invention consists of a rounded brush handle which would be made of wood or manmade material for easy application, comfort, and convenience of cosmetics. The brush head ideally uses natural or synthetic hairs. The present invention would be used with beauty or skin care products including those used for arts and special effects. This provides easy cleaning and care for the brush head. The present invention is also provided with an ergonomic shape which improves user comfort. The specifics of the present invention are subsequently addressed in more detail.

DETAIL DESCRIPTIONS OF THE INVENTION

All illustrations of the drawings are for the purpose of describing selected versions of the present invention and are not intended to limit the scope of the present invention.

Figure 1:
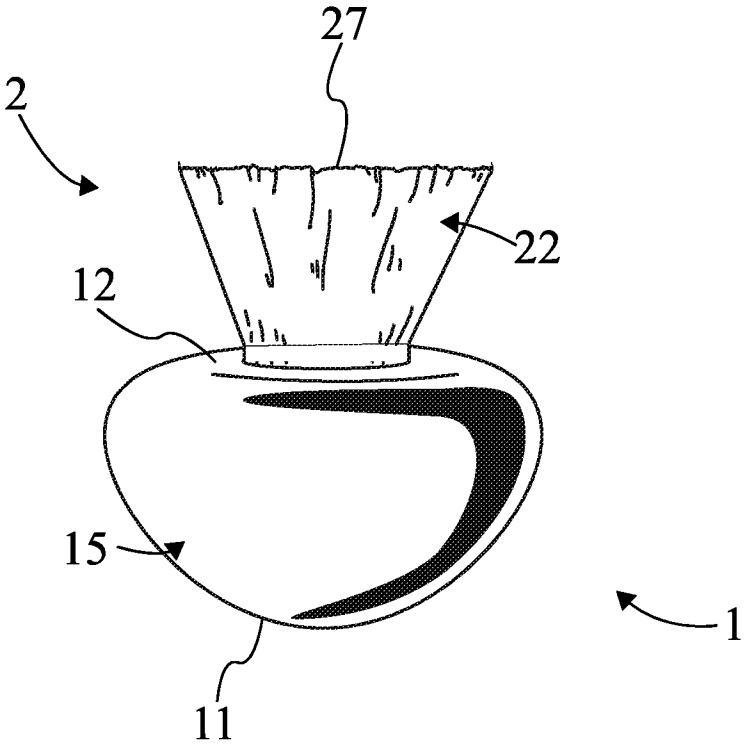
FIG. 1 is a front view showing a combined brush head and handle body of the present invention.
Figure 2:
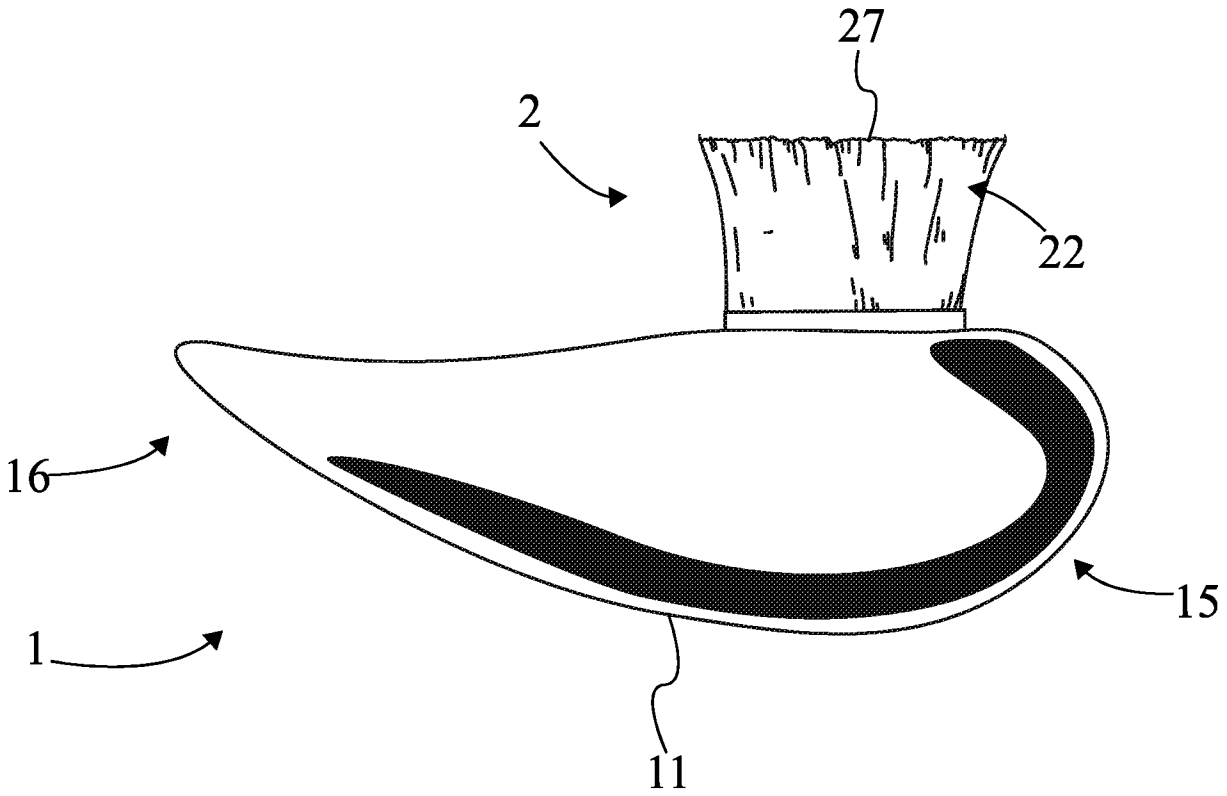
FIG. 2 is a side view showing a combined brush head and handle body of the present invention.
Figure 3:
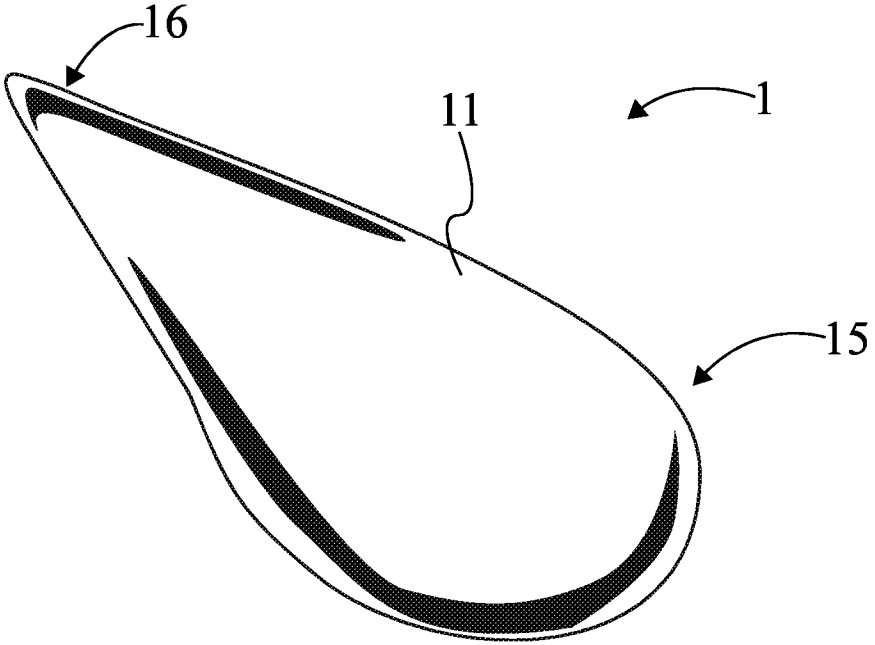
FIG. 3 is a perspective view showing a separated handle body and its curved top side.
Figure 4:
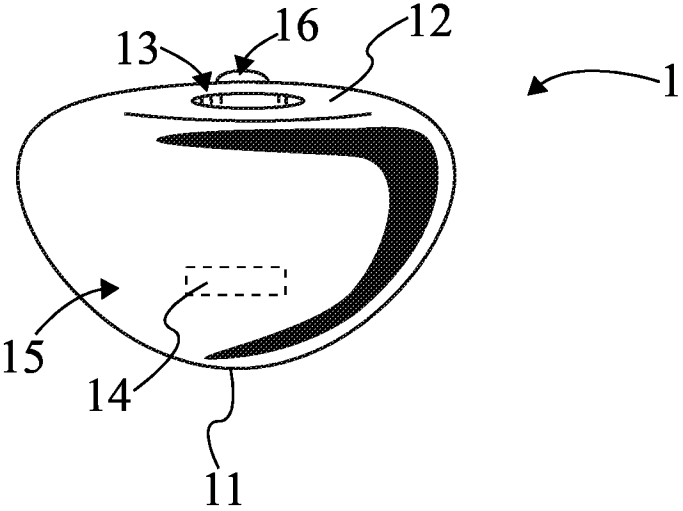
FIG. 4 is a front view showing the separated handle body, including a portion of a bottom surface and receptacle for the brush head.

The present invention is a cosmetic brush with detachable components. More specifically, the present invention comprises a handle body 1 and a brush head 2, the brush head 2 being detachably coupled to the handle body 1. This allows for users to easily swap out different brush heads 2 with the handle body 1. This is advantageous as it enables a user to use the best type of brush head 2 for a specific application. It also allows for brush heads 2 to be easily replaced if damaged. These two main components are subsequently elaborated upon. The combined handle body 1 and brush head 2 are shown together in FIG. 1 and FIG. 2.

The handle body 1 comprises a gripping surface 11, a mounting surface 12, a brush head receptacle 13, and a magnet 14. The mounting surface 12 is where the brush head 2 is attached to the handle body 1, while the gripping surface 11 is the part that a user is able to grasp with their hand. The brush head receptacle 13 is formed within the handle body 1; this receptacle is a cavity that receives a corresponding component of the brush head 2. The magnet 14 is used to engage the brush head 2 with the handle body 1, joining the two components into a singular unit which is suitable for use in cosmetics and other applications. The magnet 14 is preferably positioned at a midpoint between the brush head receptacle 13 and the gripping surface 11; this positioning ensures the magnet 14 is close enough to secure a ferrule of the brush head 2 in place, while also allowing for the gripping surface 11 to be magnetically secured to a metallic base. The handle body 1 is independently shown in FIG. 3-FIG. 6.

The brush head 2 comprises a coupling body 21 and a plurality of bristles 22. The coupling body 21 enables interfacing of the brush head 2 with the handle body 1. The plurality of bristles 22, meanwhile, supports use in cosmetic and other applications. For example, blush can be applied to a person's face via the plurality of bristles 22. Preferably, the coupling body 21 is a ferrule that secures the plurality of bristles 22. The ferrule can be made from natural or manmade materials, but must be metallic to ensure compatibility with magnet 14 of the handle body 1. The brush head 2 is independently shown in FIG. 7-FIG. 10.

The brush head 2 itself is joined to the handle body 1 by means of the brush head receptacle 13 and the coupling body 21; the coupling body 21 is positioned into the brush head receptacle 13, effectively forming a singular apparatus. Once the coupling body 21 is inserted into the brush head receptacle 13, the magnet 14 engages the metallic coupling body 21 (ferrule), holding the brush head 2 in a secure position within the handle body 1.

The above describes a general configuration of components for a core embodiment of the present invention. Several derivative and more specific embodiments are possible, a few examples of which are hereafter detailed.

In a preferred embodiment, the handle body 1 is given an ergonomic shape that is comfortable to hold in a person's hand. As shown in the accompanying figures, this ergonomic shape is incorporated into the gripping surface 11, which forms a tear-drop shape. Thus at one end the gripping surface 11 is wide and rounded, while at another end the gripping surface 11 curves to a more narrow profile. Resultantly, the gripping surface 11 comprises a bulbous portion 15 and a tail portion 16. The bulbous portion 15 is a first end of the gripping surface 11, which is wide and rounded. The gripping surface 11 tapers, decreasing in width, from the bulbous portion 15 to the tail portion 16. To create the tear-drop shape, the gripping surface 11 is curved. This is opposed to being tapered along straight lines, which would create a more angular (and less comfortable) shape compared to the desired tear-drop shape.

Figure 5:
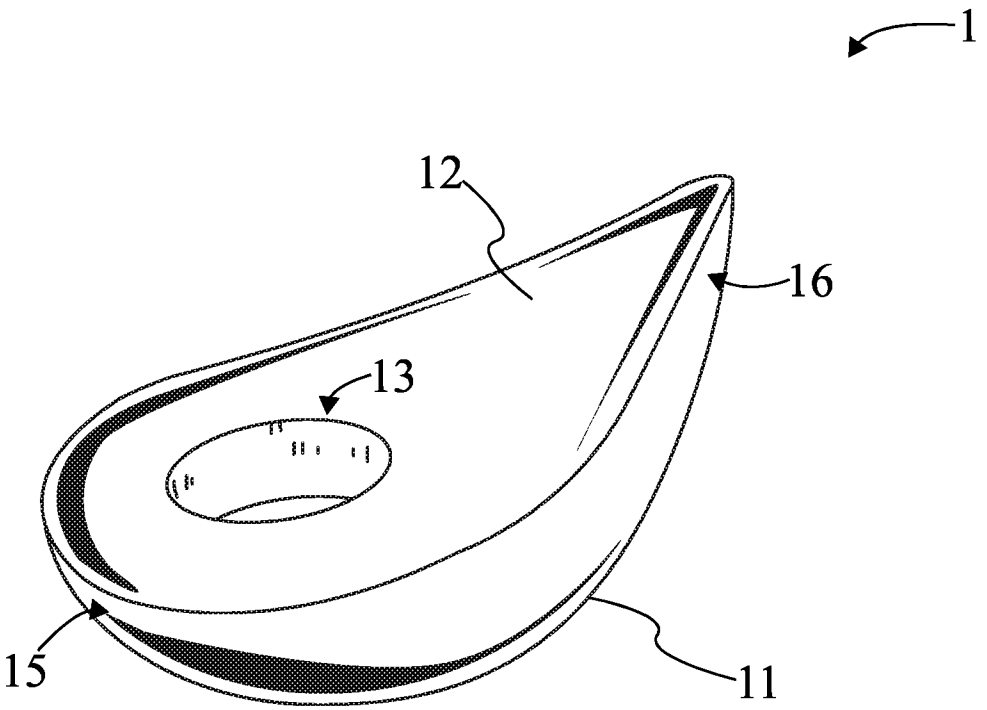
FIG. 5 is a perspective view showing a generally flat bottom surface of the separated handle body, including receptacle for the brush head.
Figure 6:
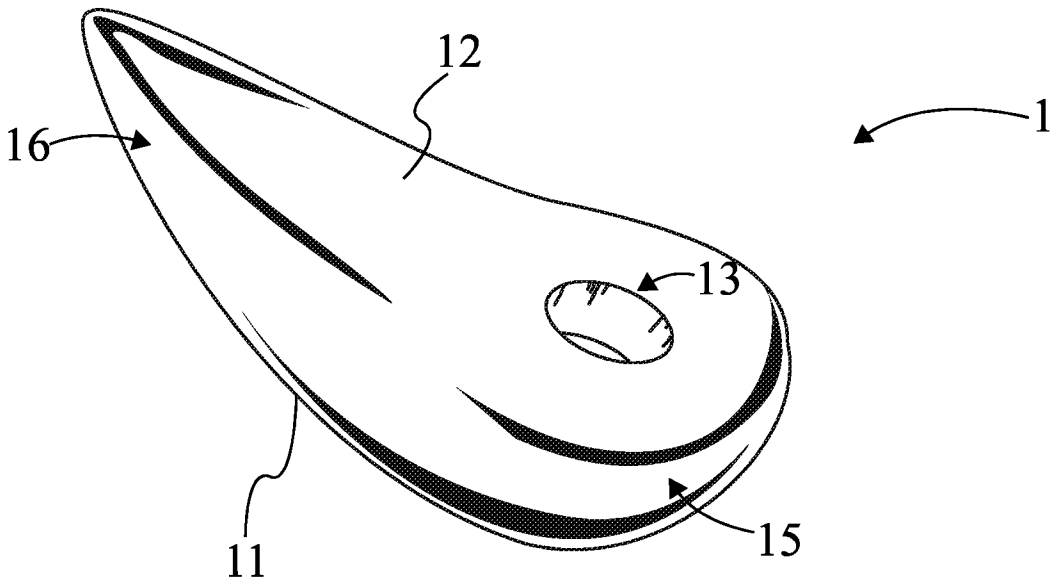
FIG. 6 is another perspective view showing the bottom surface of the separated handle body.
Figure 7:
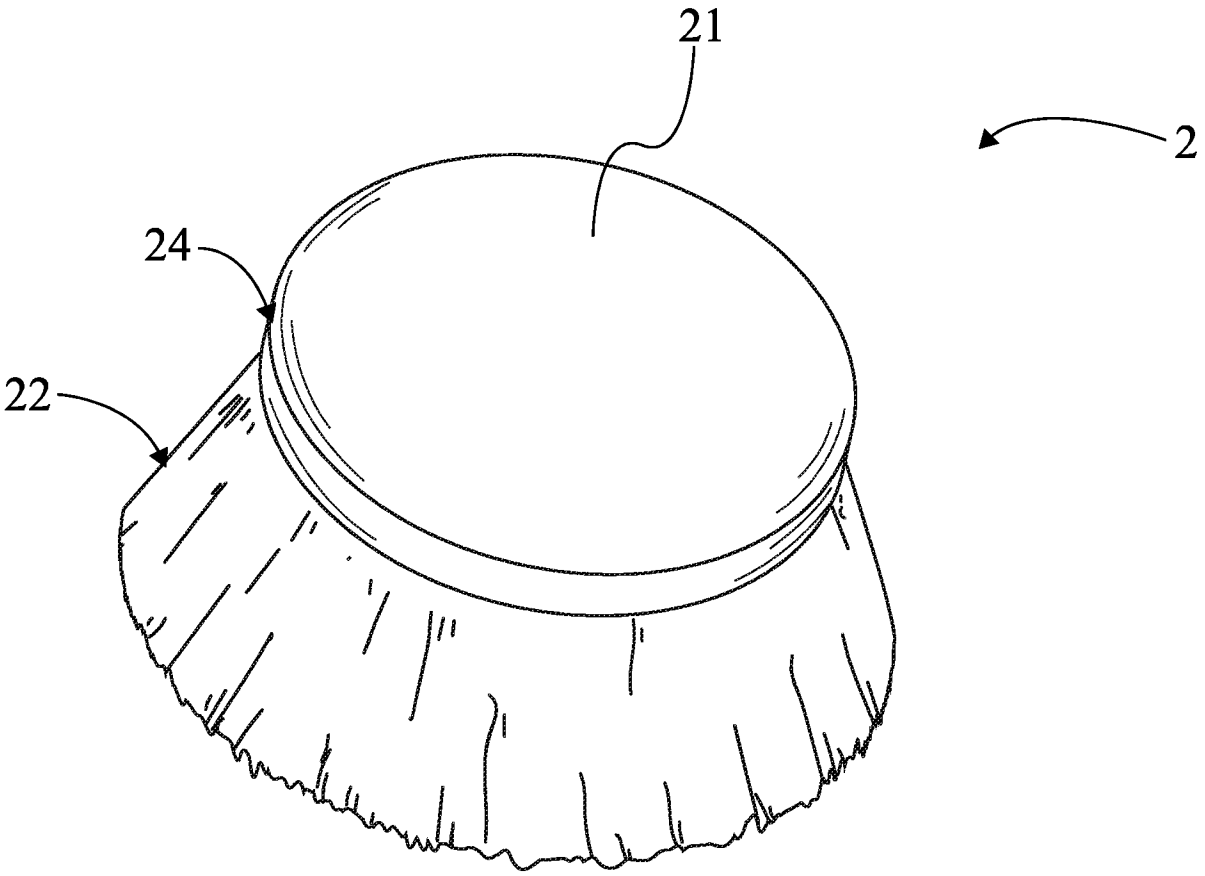
FIG. 7 is a perspective view showing a separated brush head, including portion that is placed into receptacle of handle body.
Figure 8:
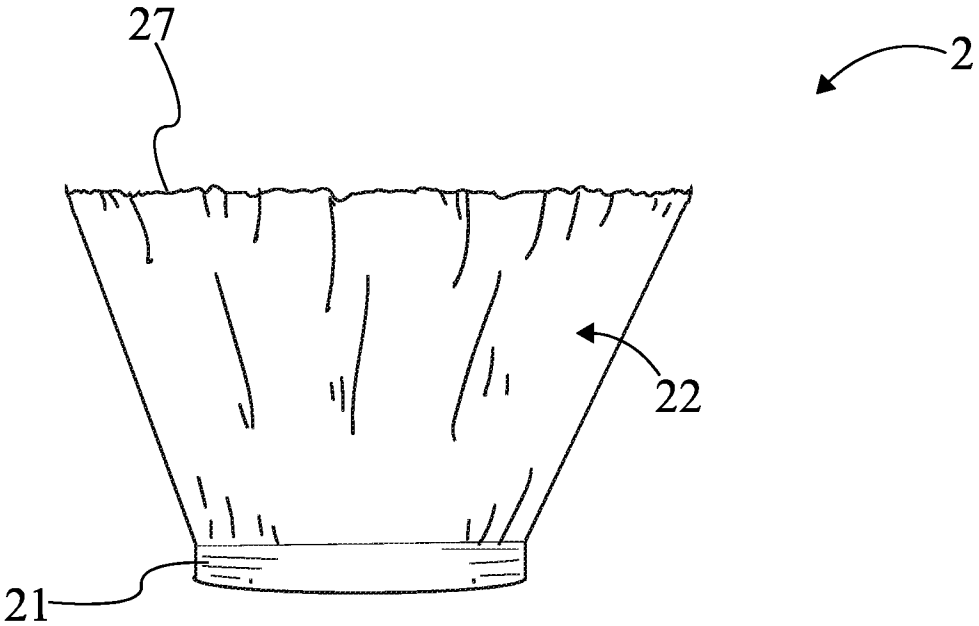
FIG. 8 is a front view showing the separated brush head.
Figure 9:
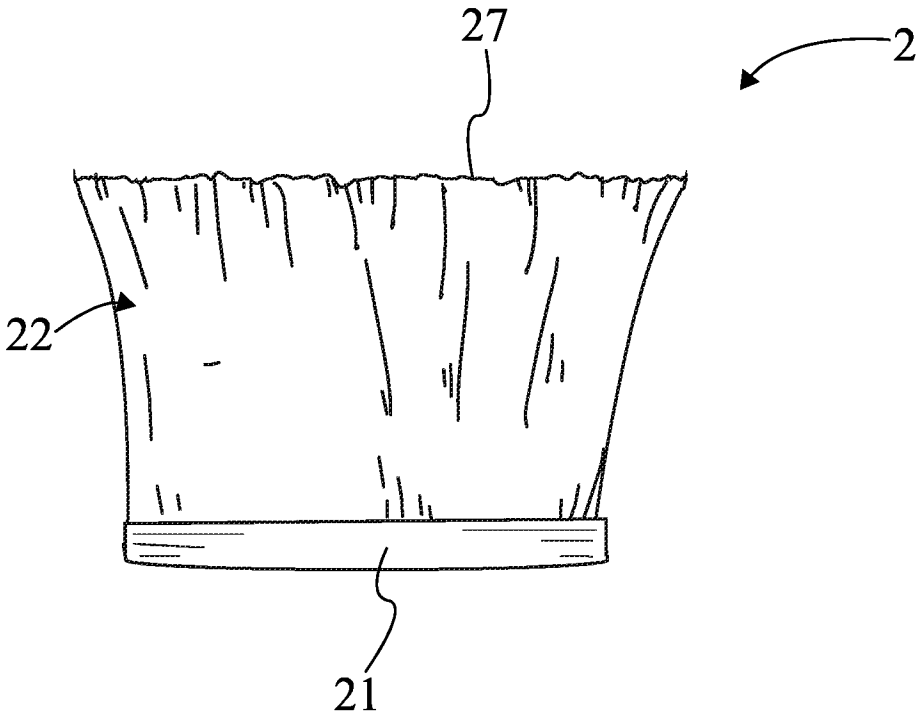
FIG. 9 is a side view showing the separated brush head.
Figure 10:
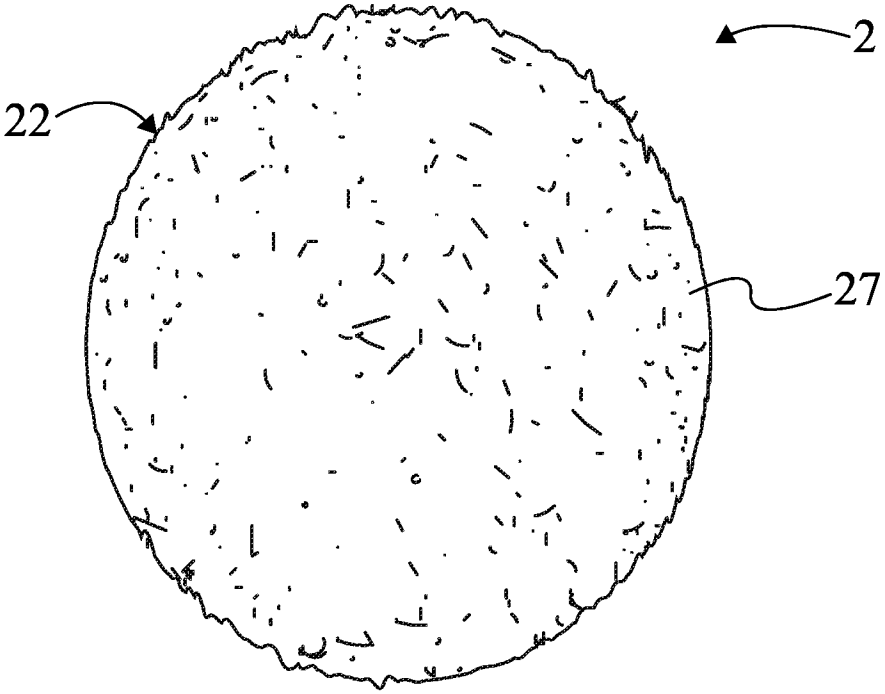
FIG. 10 is a top view showing the separated brush head.

The mounting surface 11, conversely, is preferably planar (i.e. flat) as shown in FIG. 5 and FIG. 6. The flat mounting surface 11 facilitates attachment of the brush head 2 to the handle body 1. Though other embodiments may choose to instead employ a curved mounting surface 11, the flat mounting surface 11 is preferable. While curved mounting surfaces 11 can work, they may prove to be more troublesome when trying to insert or remove the brush head 2 from the handle body 1.

Another property of the preferred embodiment is the application of magnetic attraction to securely fix the brush head 2 with the handle body 1. In the preferred embodiment, the magnet 14 is aligned with the perimeter of the coupling body 21. The magnet 14 thus prevents the coupling body 21 from shifting within the handle body 1, which would be detrimental during normal use.

Potentially, in alternative embodiments, the brush head 2 may be separable from the handle body 1, rather than being permanently connected. To support this, different coupling means could be provided. For example, a threading could be incorporated along the interior surface of the brush head receptacle 13, with a matching threading being formed around the coupling body 21. Effectively, this would allow the brush head 2 to be screwed into the handle body 1. Another possible example is using a latching mechanism (for example, a spring-loaded twist lock) to allow for attachment and detachment of the brush head 2 with the handle body 1. These are just a few examples of alternative coupling means, and not intended to limit further ones which may be compatible with the present invention. Ultimately, any mechanisms or components that allow for the brush head 2 to be attached and detached from the handle body 1 remain within the scope of the present invention. It is noted that certain brush heads 2 are not compatible with certain coupling means. An example of such an incompatibility is the inability of non-circular brush heads 2 to be screwed into the handle body 1, as non-circular shapes cannot rotate within the handle body 1.

Other possible variations of the present invention are possible with respect to the brush head 2. More specifically, several shapes can be created for the brush head 2. For example, the plurality of bristles 22 may be arranged in several patterns on the coupling body 21; possible examples that can be combined with the tear-drop shape handle body 1 include a circular shape 24, a rectangular shape 25, a petal shape 261, and a diamond shape 262 as shown in FIG. 11, FIG. 12, FIG. 13, and FIG. 14, respectively.

The plurality of bristles 22, in addition to being outlined by a perimeter shape (such as the examples mentioned above), creates an applicator surface 27. The applicator surface is delineated by the top of the plurality of bristles 22. In different embodiments, different shapes may be given to the applicator surface 27.

Figure 11:
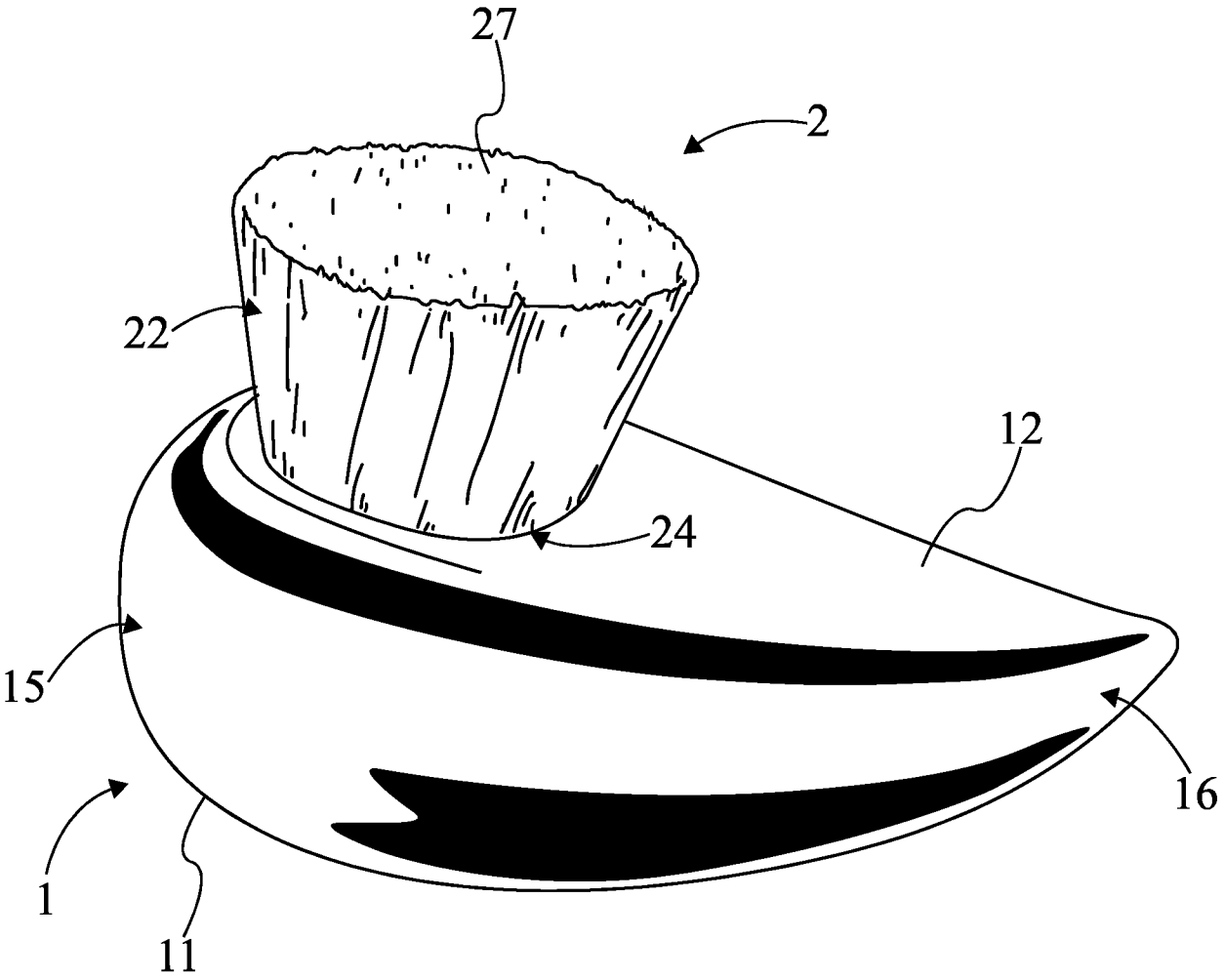
FIG. 11 is a perspective view showing one embodiment of the present invention, with a flat and circular-shaped brush.
Figure 12:
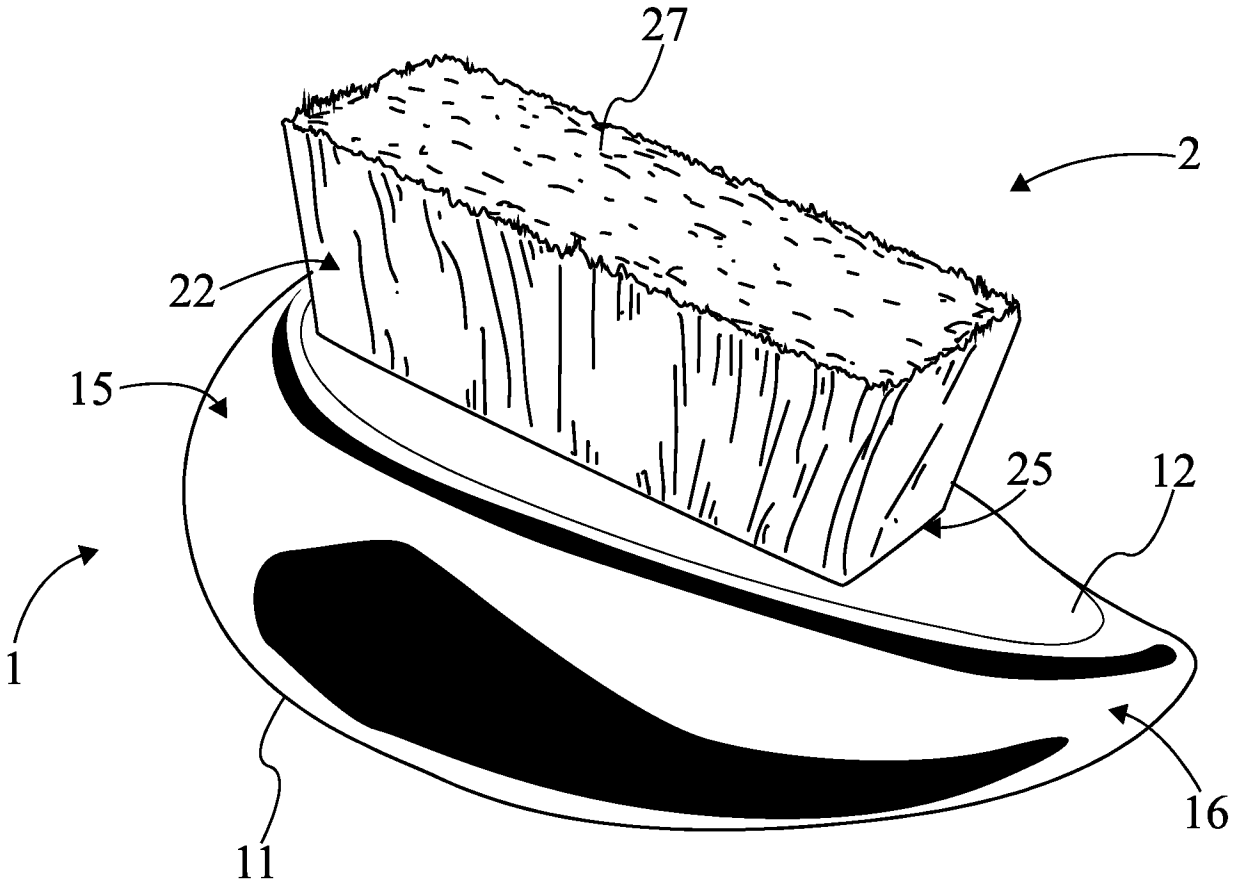
FIG. 12 is a perspective view showing one embodiment of the present invention, with a flat and rectangular-shaped brush.
Figure 13:
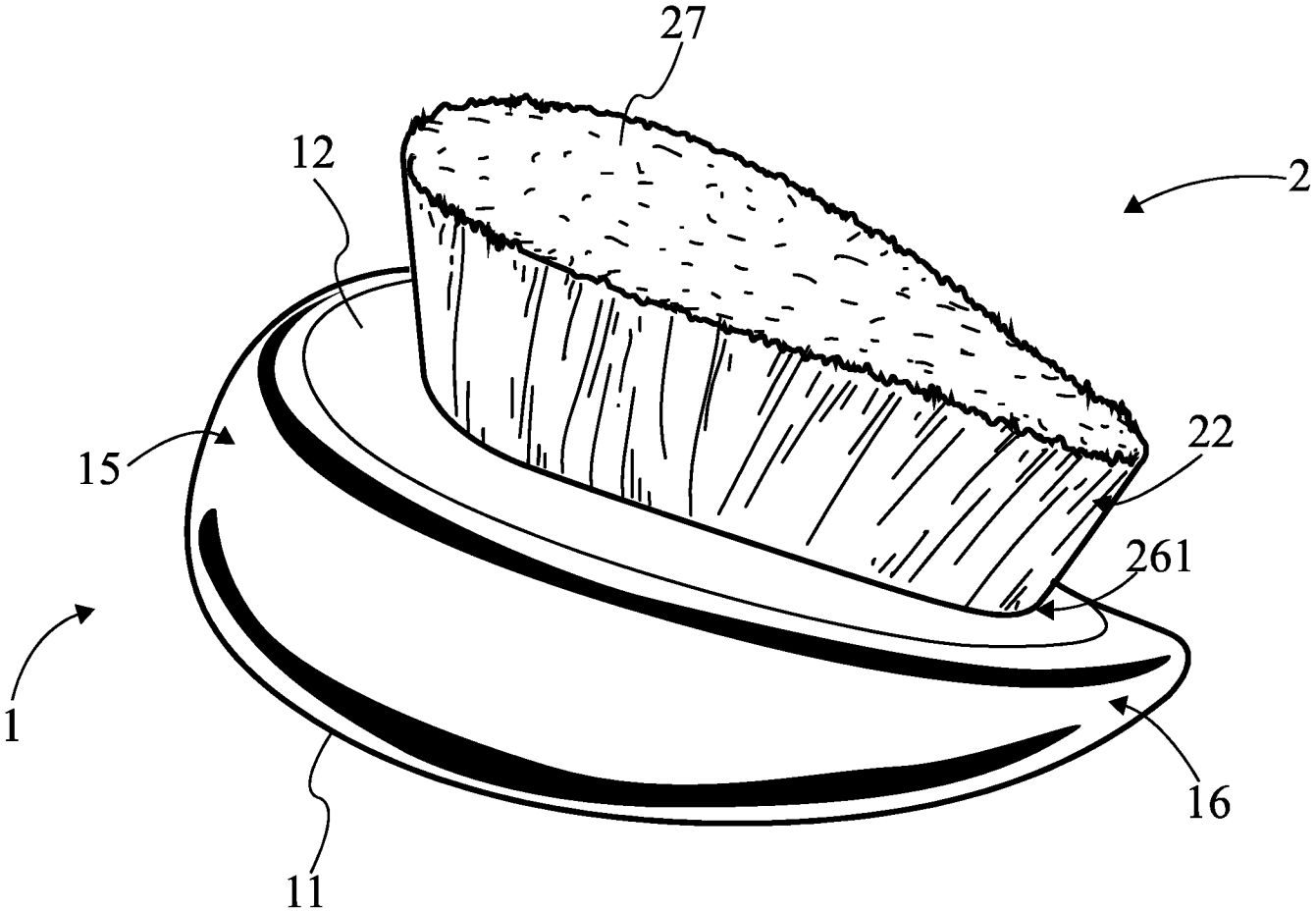
FIG. 13 is a perspective view showing one embodiment of the present invention, with a flat and petal-shaped brush.
Figure 14:
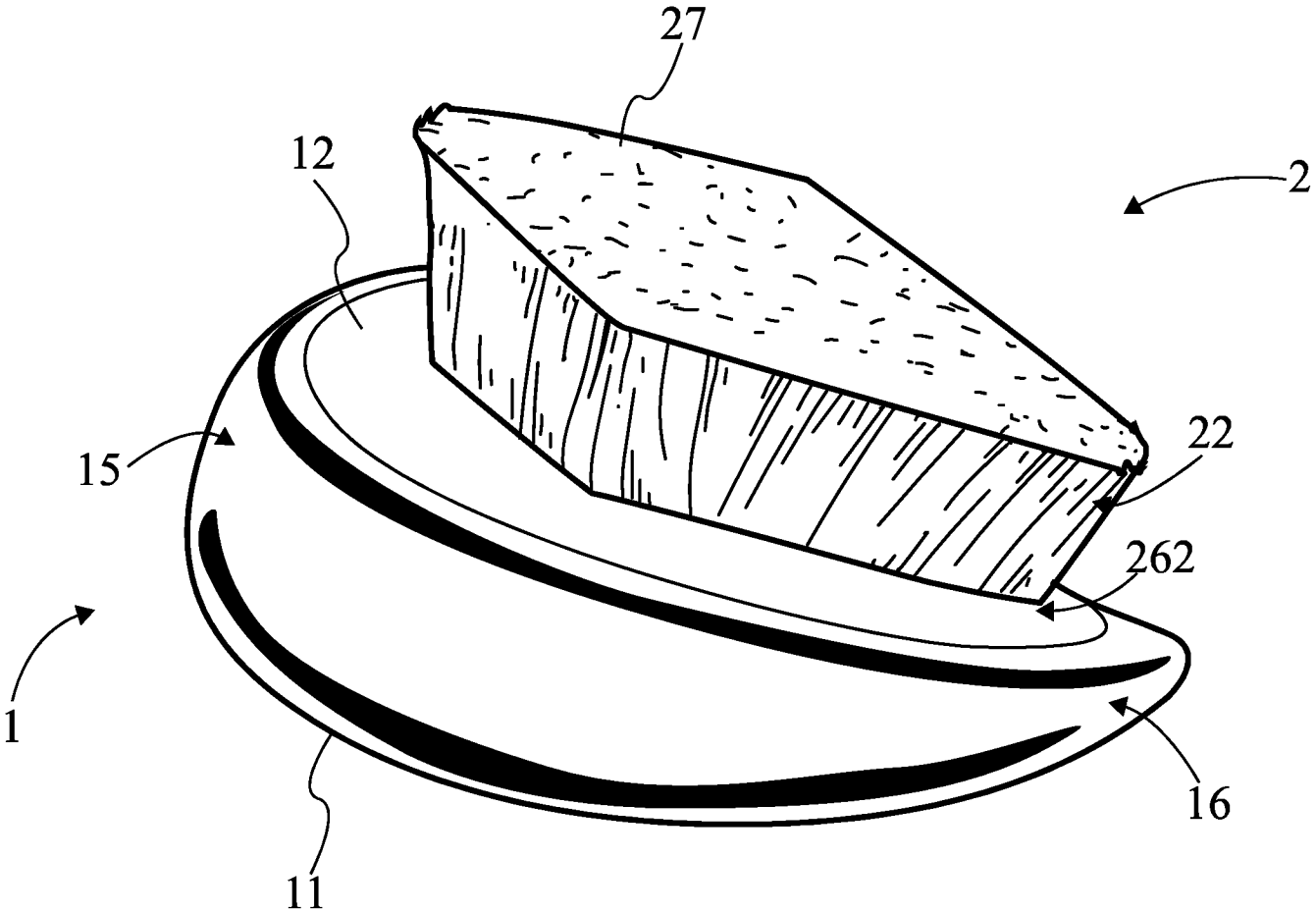
FIG. 14 is a perspective view showing one embodiment of the present invention, with a flat and diamond-shaped brush.
Figure 15:
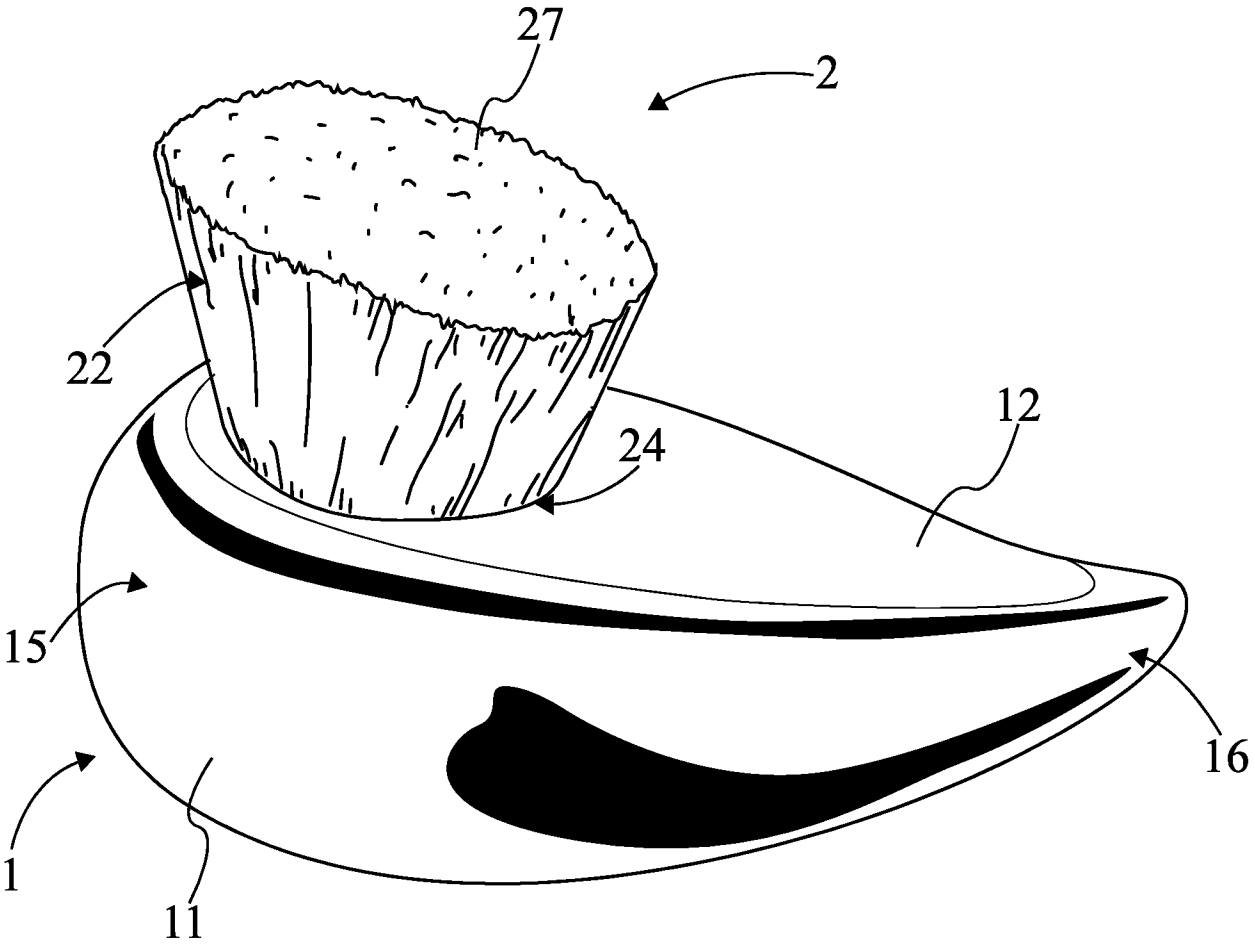
FIG. 15 is a perspective view showing one embodiment of the present invention, with an inclined and circular-shaped brush.

For example, in one embodiment, the plurality of bristles 22 are configured to create a planar (i.e. not curved) applicator surface 27. The flat applicator surface 27 can be further separated into a level surface or an inclined surface. A level surface is defined as when the applicator surface 27 is parallel with an upper surface of the coupling body 21, as shown in FIG. 11. An inclined surface is defined as when the applicator surface 27 is angularly offset at an acute angle 28 from the upper surface of the coupling body 21, as shown in FIG. 15.

Figure 16:
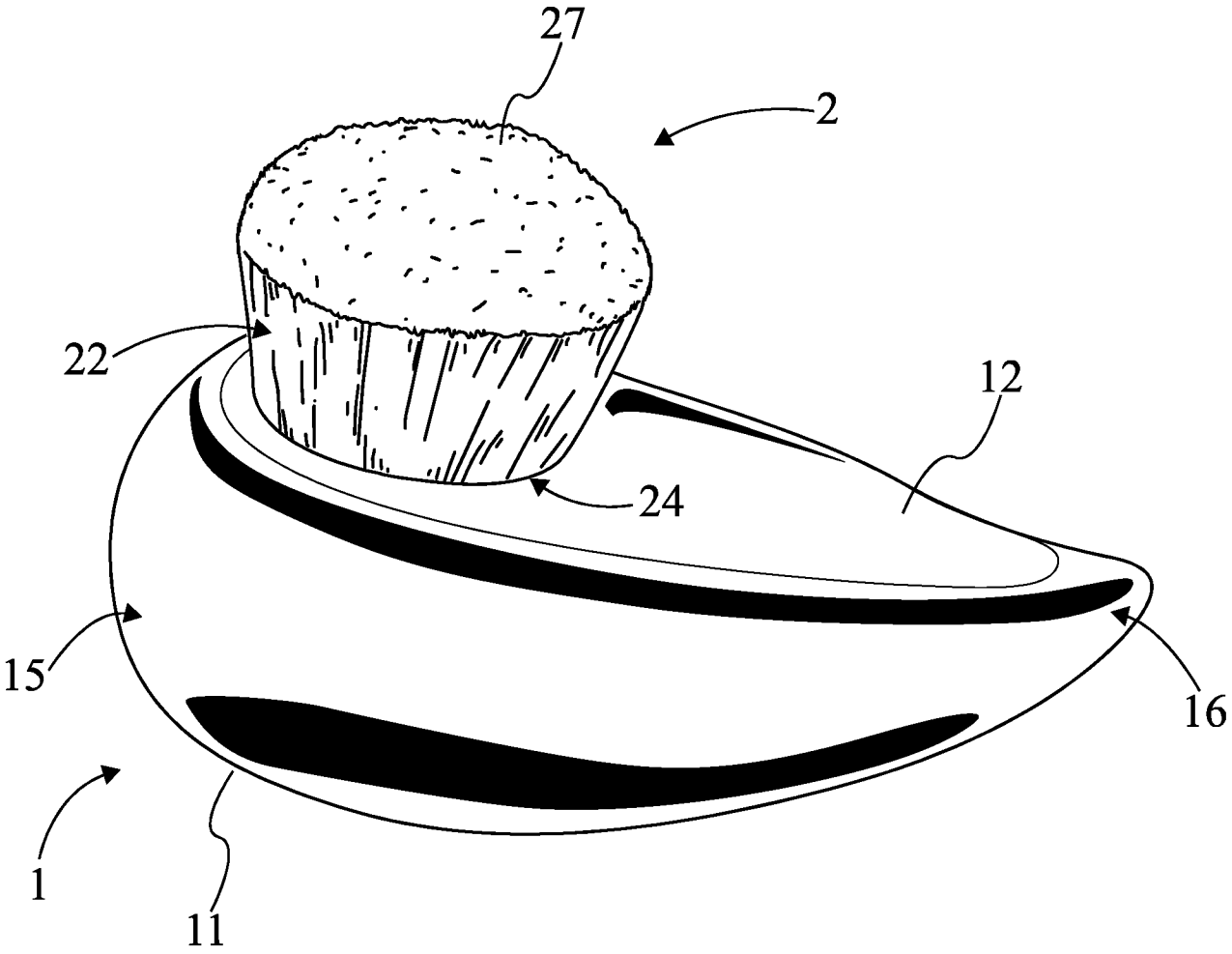
FIG. 16 is a perspective view showing one embodiment of the present invention, with a domed and circular-shaped brush.

In another embodiment, the plurality of bristles 22 are configured to create a convex applicator surface 27, i.e. a curved one. An example of this is shown in FIG. 16, in which the top of the plurality of bristles 22 has a dome shape. As with the planar applicator surface 27, subsets of the convex applicator surface 27 are possible; an example parameter includes radius of curvature, which could be constant or variable.

While the present invention describes flat and concave applicator surfaces 27 in the example embodiments, further variations to the shape of the applicator surface 27 are possible. As one of the advantages of the present invention is the ability to easily switch out brush heads 2, different shapes of applicator surfaces 27 can be provided for specific cosmetic applications.

Several different materials may be utilized in conjunction with the present invention. The handle body 1 itself, for example, is preferably made from a rigid and durable material. Possible examples include metals, wood, plastics, and other natural or synthetic materials that manufacturers may mold into the desired shape. The plurality of bristles 22 may be formed from naturally occurring hairs, or could alternatively be artificially created from silicone-coated filaments. As different materials may be desirable for specific cosmetic applications, the present invention is once again advantageous as it allows for using the best brush head 2 for any given application.

A non-slip material (for example rubber or silicone) may be used for the gripping surface 11 of the handle body 1. In different embodiments of the present invention, this grip could be integrated into the handle body 1 as a molded and connected piece. Alternatively, in some embodiments, the non-slip material can be applied onto the handle body 1 (for example, a rubberized spray) rather than molded. These are just a few ways that the non-slip material can be incorporated, and does not limit further implementations of said non-slip material.

Although the invention has been explained in relation to its preferred embodiment, it is to be understood that many other possible modifications and variations can be made without departing from the spirit and scope of the invention as hereinafter claimed.

What is claimed is:

1. A cosmetic brush comprising:

a handle body;

a brush head;

the handle body comprising a gripping surface, a mounting surface and a brush head receptacle;

the brush head comprising a coupling body and a plurality of bristles;

the brush head receptacle traversing into the handle body through the mounting surface;

the coupling body being positioned into the brush head receptacle;

the plurality of bristles being patterned across the coupling body;

the plurality of bristles being connected to the coupling body;

the brush head being coupled with the handle body;

the plurality of bristles being patterned into a petal shape;

each of the plurality of bristles being made from a group consisting of silicone-coated filaments, natural hairs, synthetic hairs and manmade materials;

the gripping surface comprising a bulbous portion and a tail portion;

the gripping surface being tapered from the bulbous portion to the tail portion;

the gripping surface being curved;

the handle body being tear-drop shaped;

the mounting surface comprising a planar portion and a concave portion;

the planar portion being adjacently positioned to the bulbous portion;

the concave portion being adjacently positioned to the tail portion; and the brush head receptacle traversing into the handle body through the planar portion.

2. The cosmetic brush as claimed in claim 1 comprising:

the coupling body being positioned adjacent to a magnet, wherein the brush head is magnetically coupled with the handle body.

3. The cosmetic brush as claimed in claim 1 comprising:

the plurality of bristles being patterned into an elongated shape.

4. The cosmetic brush as claimed in claim 1 comprising:

the plurality of bristles comprising an applicator surface; and the applicator surface being positioned opposite the coupling body.

5. The cosmetic brush as claimed in claim 4 comprising:

the applicator surface being planar; and the applicator surface being parallel with the coupling body.

6. The cosmetic brush as claimed in claim 4 comprising:

the applicator surface being planar; and the applicator surface being oriented at an acute angle relative to the coupling body.

7. The cosmetic brush as claimed in claim 4 comprising:

the applicator surface being convex.

8. The cosmetic brush as claimed in claim 1 comprising:

a magnet;

the magnet being disposed in the brush head receptacle; and the brush head being detachably coupled with the handle body by the magnet affixing the coupling body within the brush head receptacle.

9. The cosmetic brush as claimed in claim 8 comprising:

the coupling body being a metallic coupling body.

10. The cosmetic brush as claimed in claim 1 comprising:

the brush head being permanently coupled with the handle body.

* * * * *